US006001051A

United States Patent [19]

Chuan-Pin

[11] Patent Number: 6,001,051

[45] Date of Patent: Dec. 14, 1999

[54] BODY EXERCISER

[76] Inventor: Chang Chuan-Pin, P.O. Box 24-108, Taipei, Taiwan

[21] Appl. No.: 09/098,006

[22] Filed: Jun. 15, 1998

[51] Int. Cl.[6] ..... A63B 21/00

[52] U.S. Cl. ..... 482/131; 482/132; 482/95; 482/96; 482/142

[58] Field of Search ..... 482/95, 96, 907, 482/148, 142, 121, 130, 131, 132, 135, 140

[56] References Cited

U.S. PATENT DOCUMENTS

| | | | |
|---|---|---|---|
| 495,304 | 8/1953 | Bell . | |
| 2,129,262 | 9/1938 | Cole . | |
| 3,465,750 | 9/1967 | Schawalder . | |
| 3,572,701 | 3/1971 | Agamian . | |
| 3,682,475 | 8/1972 | Walker . | |
| 3,752,475 | 8/1973 | Ott . | |
| 5,004,229 | 4/1991 | Lind . | |
| 5,163,890 | 11/1992 | Perry | 482/142 |
| 5,221,246 | 6/1993 | Torii | 482/144 |
| 5,261,866 | 11/1993 | Mattox | 482/125 |
| 5,464,378 | 11/1995 | Yu | 482/95 |
| 5,499,961 | 3/1996 | Mattox | 482/132 |
| 5,518,483 | 5/1996 | Oswald | 482/131 |
| 5,531,658 | 7/1996 | LSC | 482/142 |
| 5,580,340 | 12/1996 | Yu | 482/96 |
| 5,584,784 | 12/1996 | Wu | 482/95 |
| 5,766,188 | 6/1998 | Conner | 482/129 |

FOREIGN PATENT DOCUMENTS

| | | |
|---|---|---|
| 495304 | 8/1953 | Canada . |

*Primary Examiner*—Jerome W. Donnelly
*Assistant Examiner*—William LaMarco

[57] ABSTRACT body exerciser including a frame base having front and rear support rods adapted to support the exerciser on the floor and a long foldable or retractable stem between the support rods; a link having a lower end pivotally connected to the stem near the rear support rod and an upper end provided with a pad; a slide seat pivotally mounted on the stem at a suitable position and having a handgrip unit disposed thereon; a drag bar having one end pivotally connected to the upper end of the link with the other end pivotally connected to the slide seat; and elastic bands or springs connecting the drag bar and the link as well as the stem. In use, the user may stand on a step pad at the rear support rod with his/her abdomen pressing against the pad on the link and both hands holding the handgrip unit while exerting forces using the abdomen and hips, combined with the of his/her body, to cause the link to incline forwardly to thereby push the slide seat forwardly. The slide seat will automatically reset when the forces thereon are removed due to the elasticity of the elastic bands or springs.

5 Claims, 5 Drawing Sheets

BODY EXERCISER

BACKGROUND OF THE INVENTION (A) Field of the Invention

The present invention relates generally to an exercising apparatus, and more particularly to a body exerciser that allows user to exercise all parts of the body especially the abdomen and hip muscles and that is adjustable to suit users having different needs and to meet different training requirements.

(B) Description of the Prior Art

As people are more and more concerned with their health and physical fitness, exercising apparatuses have become very popular. However, most of the exercising apparatuses allow the user to exercise the arms or legs and few are available to train the abdomen or hips. It is therefore desirable to have an exercising apparatus that allows the user to exercise all parts of the body, especially the abdomen and hips and that is compact for use at home.

SUMMARY OF THE INVENTION

A primary object of the present invention is to provide a body exerciser that allows the user to exercise all parts of his/her body especially the abdomen and hip muscles.

Another object of the present invention is to provide a body exerciser having an adjustable frame and adjustable elastic means to suit users having different physiques and to meet different training requirements.

In order to achieve the above-mentioned objects, the present invention comprises a frame base having front and rear support rods adapted to support the exerciser on the floor and a long foldable or retractable stem between the support rods; a link having a lower end pivotally connected to the stem near the rear support rod and an upper end provided with a pad; a slide seat pivotally mounted on the stem at a suitable position and having a handgrip unit disposed thereon; a drag bar having one end pivotally connected to the upper end of the link with the other end pivotally connected to the slide seat; and elastic bands or springs connecting the drag bar and the link as well as the stem. In use, the user may stand on a step pad at the rear support rod with his/her abdomen pressing against the pad on the link and both hands holding the handgrip unit while exerting forces using the abdomen and hips, combined with the of his/her body, to cause the link to incline forwardly to thereby push the slide seat forwardly. The slide seat will automatically reset when the forces thereon are removed due to the elasticity of the elastic bands or springs.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
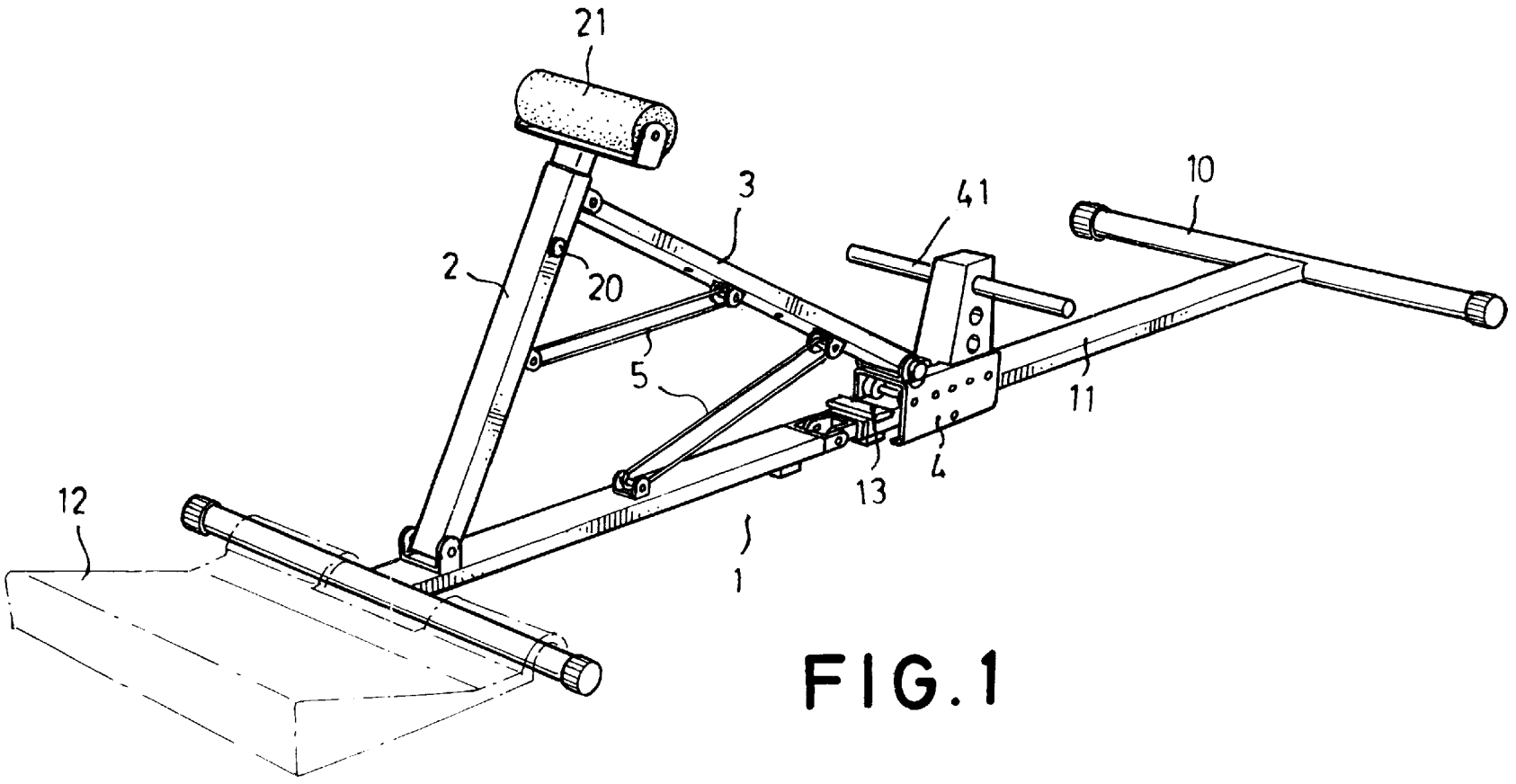
FIG. 1 is a perspective view of an embodiment of the present invention.
Figure 2:
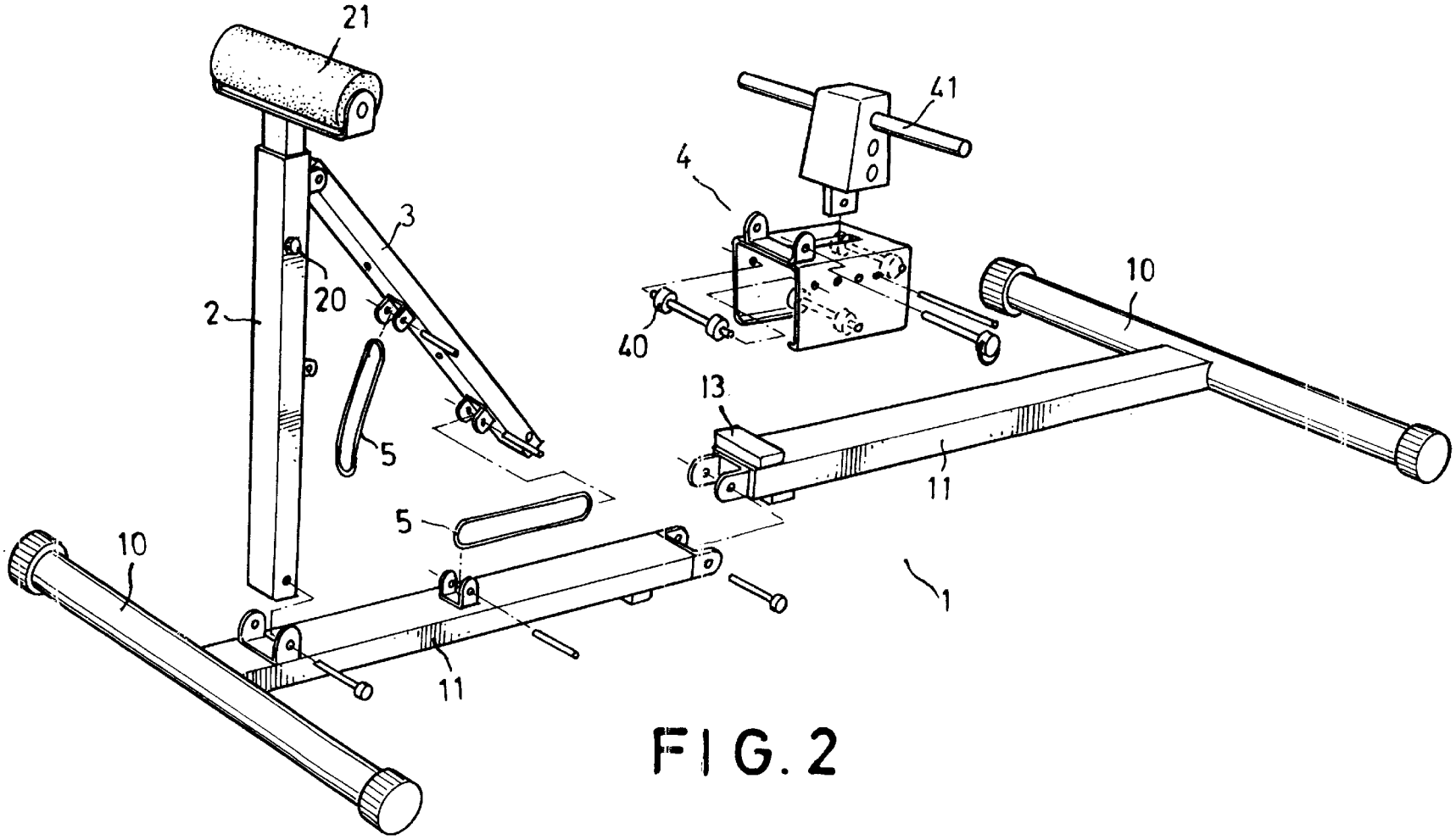
FIG. 2 is a perspective exploded view of the embodiment of the present invention.
Figure 3:
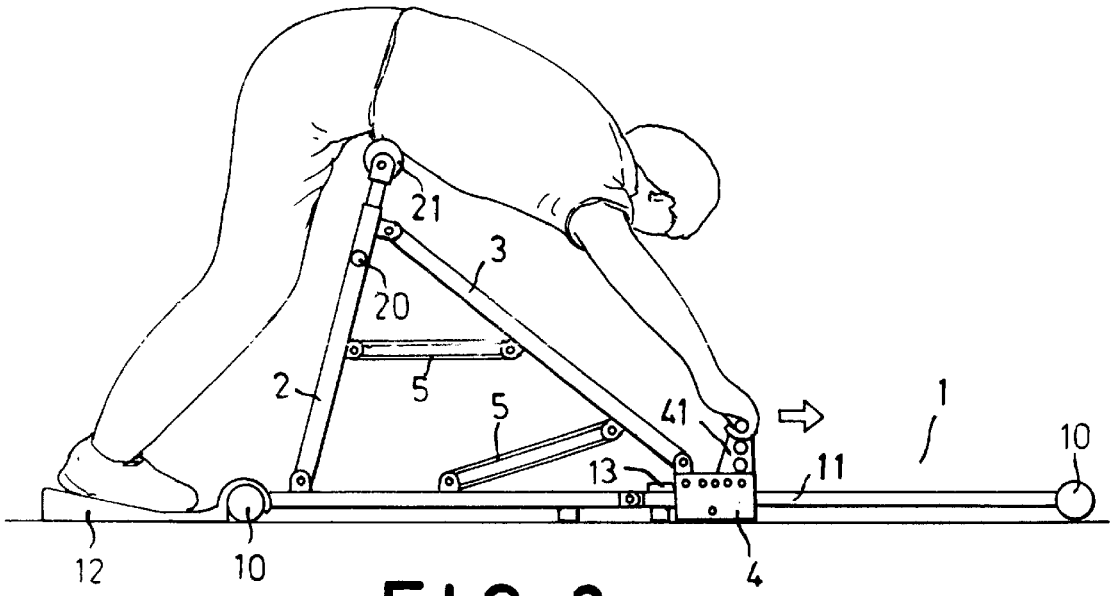
FIG. 3 is a schematic side view illustrating use of the present invention in one way.
Figure 4:
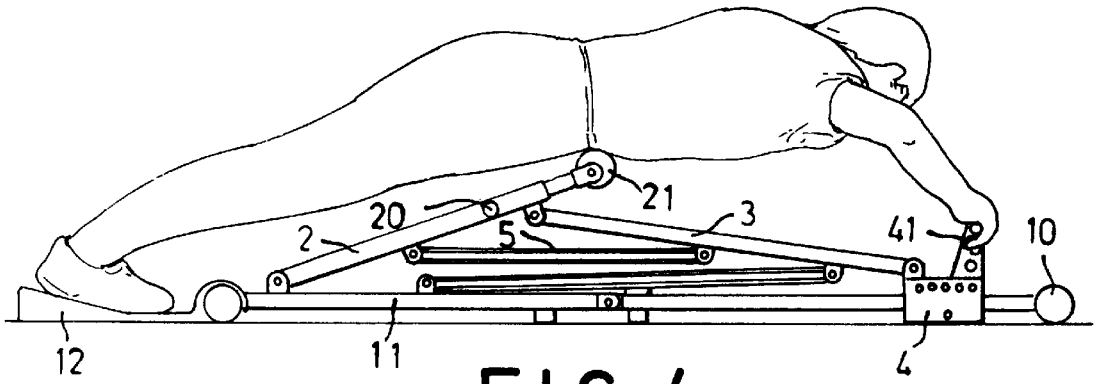
FIG. 4 is a schematic side view illustrating use of the present invention in another way.

With reference to the drawings, the present invention is shown to comprise a frame base 1, a link 2, a drag bar 3, a slide seat 4, and elastic bands or springs 5.

Figure 5:
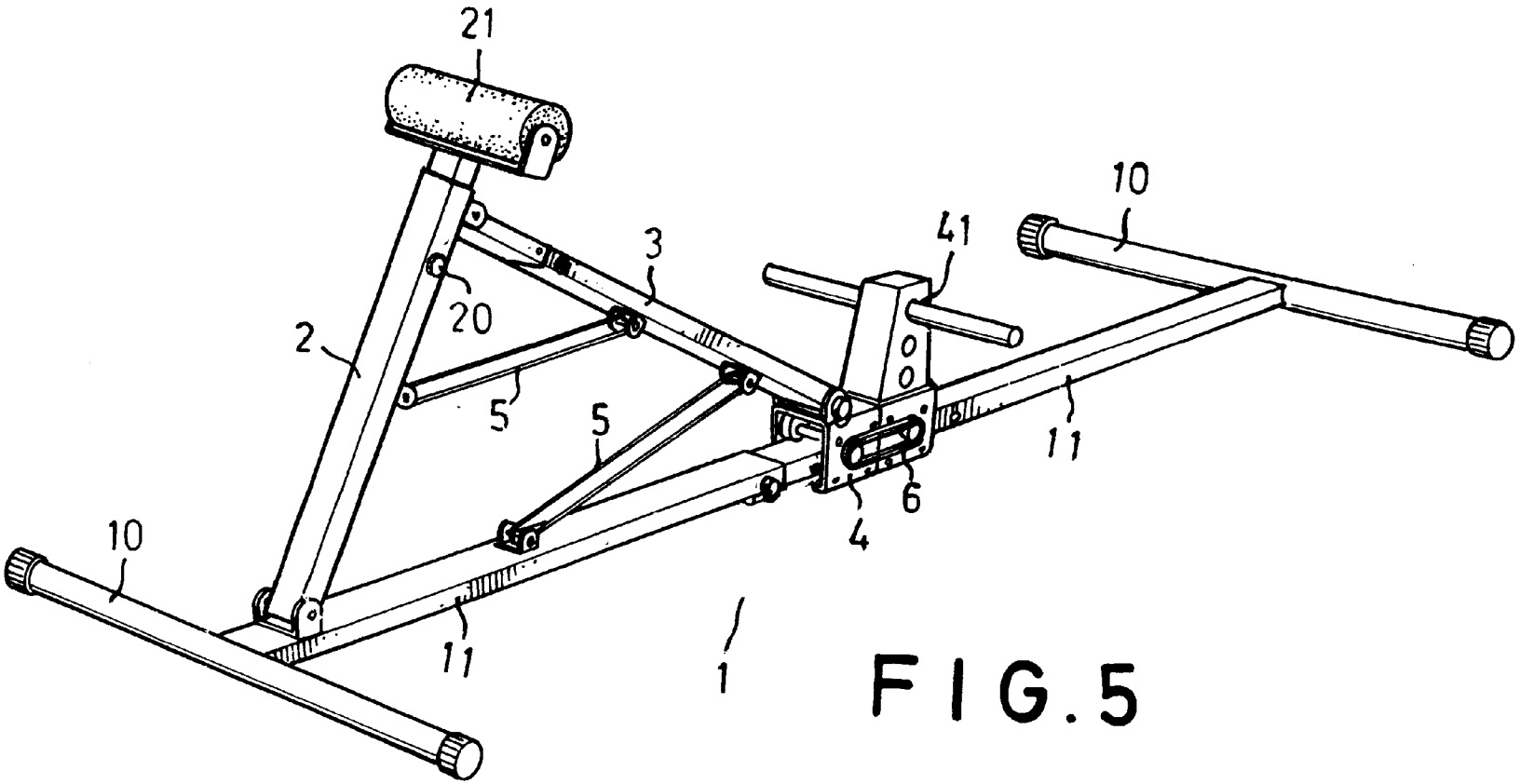
FIG. 5 is a perspective view of another embodiment of the present invention.
Figure 6:
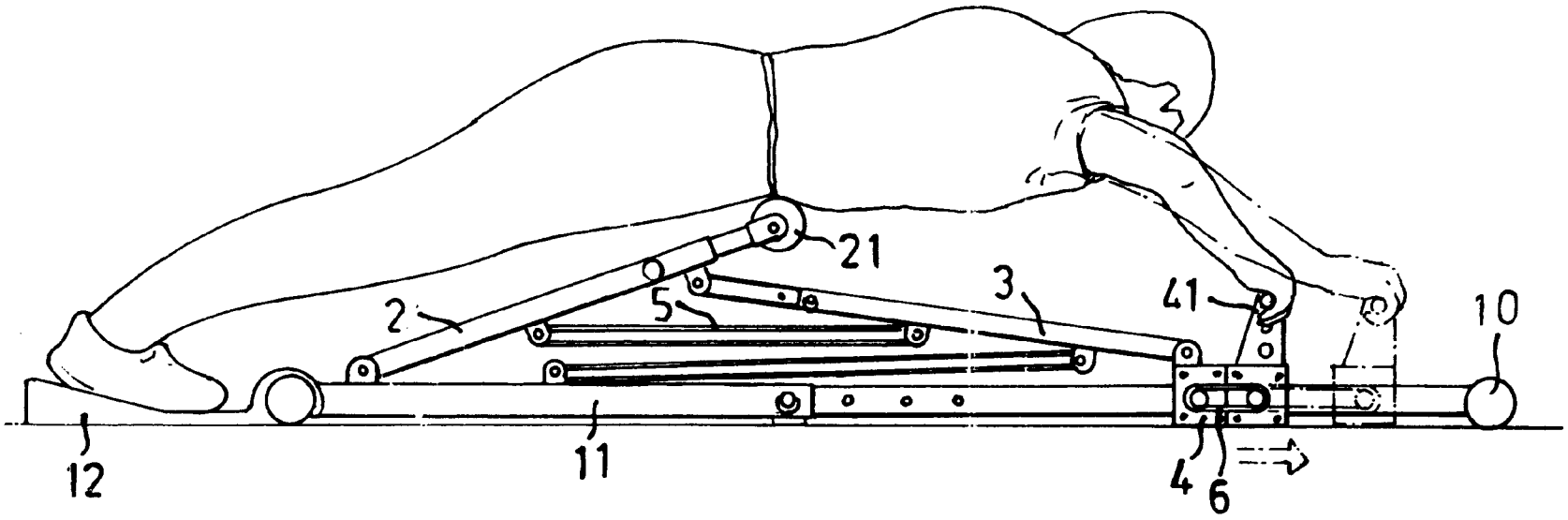
FIG. 6 is a schematic side view of the embodiment of the present invention in FIG. 5.

The frame base 1 includes two support rods 10 at front and rear ends to support the present invention on the floor, a long foldable or retractable stem 11 between the two ends. In order to facilitate use and avoid friction in use, a step pad 12 may be provided on the support rods 10 at the rear end. A lower end of the link 2 is secured to the stem 11 near the support rod 10 at the rear end by locking screws 20. An upper end of the link 2 is provided with a pad 21 which may be turnable or fixed. One end of the drag bar 3 is pivotally connected to the upper end of the link 2 below the pad 21. If necessary, the drag bar 3 may also be configured to be retractable and adjustable, as shown in FIGS. 5 and 6. The other end of the drag bar 3 is pivotally connected to the slide seat 4 on the stem 11 by pulleys 40. The slide seat 4 is provided with a handgrip unit 41 thereon, the handgrip unit includes two handgrip portions one on each side. The position of the handgrip unit 41 is adjustable. As shown in FIGS. 5 and 6, a second set of elastic bands or springs 6 may be provided on the slide seat 4 such that the handgrip unit 41 may be elastically pulled away from the slide seat 4. Elastic bands or springs 5 are provided to connect the drag bar 3, the link 2, the frame base 1, and the stem 11 at suitable positions. A stop 13 is provided at a central portion of the stem 11 to limit the position of the slide seat 4 when the latter is pulled back by the elastic bands or springs 5.

In use, the user may firstly adjust the lengths and positions of the link 2, handgrip unit 41, and drag bar 3 to match his/her height and length of his/her arms. Then the user may step on the support rod 10 or step pad 12 at the rear end of the frame base 1 with his/her face turning downwardly, abdomen pressing against the pad 21 at the upper end of the link 2, and both hands holding the handgrip portions on the slide seat 4. By utilizing the weight of his/her body and exerting a downward force with his/her abdomen and hips, the user may push the link 2 to incline forwardly, causing the drag bar 3 connected thereto to push the slide seat 4 to slide forwardly. Since there are provided elastic bands or springs 5, when the force applied is removed or the resetting force of the elastic bands or springs 5 is greater than the force applied, the elastic bands or springs 5 will reset. Then the user may repeat the exercise to train the muscles of the waist, abdomen and hips.

If the handgrip unit 41 and the slide seat 4 are configured to be separable as shown in FIGS. 5 and 6, the user may, when the link 2 inclines forwardly, push the handgrip unit 41 forwardly using the forces of both arms, so that the handgrip unit 41 stretches the elastic bands or springs 6 forwardly, thus achieving exercising of the hand and arm muscles. The number of elastic bands or springs 5 between the drag bar 3 and link 2 and between the drag bar 3 and the stem 11 as well as the elastic bands or springs 6 between the slide seat 4 and handgrip unit 41, the stretching forces may be easily adjusted when the elastic bands or springs become relaxed after having been used for a period of time or to suit users having different needs. It can be appreciated from the above that the body exerciser according to the present invention is simple in construction and suitable for use at homes. Besides, the cost of manufacture is low.

Although the present invention has been illustrated and described with reference to the preferred embodiment thereof, it should be understood that it is in no way limited to the details of such embodiment but is capable of numerous modifications within the scope of the appended claims.

What is claimed is:

1. A body exerciser comprising:

a frame base including front and rear support rods adapted to support said body exerciser on the floor, and a long foldable or retractable stem between said support rods;

a link having a lower end pivotally connected to said stem near said support rod at the rear end of said frame base and an upper end having a turnable or fixed pad disposed thereon;

a slide seat slidably mounted on said stem of said frame base at a suitable position; said slide seat having an adjustable handgrip unit provided thereon;

a drag bar having one end pivotally connected to said link at the upper end with the other end pivotally connected to said slide seat;

elastic means provided between said drag bar and said link and between said drag bar and said stem of said frame base at suitable positions;

said stem being provided with a stop at a central position to limit the position of said slide seat when subjected to the pulling force of said elastic means.

2. A body exerciser as defined in claim 1, wherein said handgrip unit is separable from said slide seat by means of a second elastic means when a force is applied on said handgrip unit to push it away from said slide seat.

3. A body exerciser as defined in claim 1, wherein said drag bar is retractable.

4. A body exerciser as defined in claim 1, wherein said elastic means are elastic bands.

5. A body exerciser as defined in claim 1. wherein said elastic means are springs.

* * * * *